US010400511B2

(12) United States Patent
Netecke et al.

(10) Patent No.: US 10,400,511 B2
(45) Date of Patent: Sep. 3, 2019

(54) HYDRAULICALLY DEACTIVATED CLAMP

(71) Applicant: Cameron Rig Solutions, Inc., Houston, TX (US)

(72) Inventors: Michael R. Netecke, Houston, TX (US); Farzad Azizi, Sugar Land, TX (US)

(73) Assignee: Cameron Rig Solutions LLC, Houston, TX (US)

( * ) Notice: Subject to any disclaimer, the term of this patent is extended or adjusted under 35 U.S.C. 154(b) by 737 days.

(21) Appl. No.: 14/602,085

(22) Filed: Jan. 21, 2015

(65) Prior Publication Data

US 2015/0204147 A1 Jul. 23, 2015

Related U.S. Application Data

(60) Provisional application No. 61/930,451, filed on Jan. 22, 2014.

(51) Int. Cl.

| | |
|---|---|
| ***E21B 3/02*** | (2006.01) |
| ***E21B 33/06*** | (2006.01) |
| ***E21B 19/16*** | (2006.01) |

(52) U.S. Cl.

CPC ..... *E21B 3/02* (2013.01); *E21B 19/16* (2013.01); *E21B 33/06* (2013.01)

(58) Field of Classification Search

CPC ..... E21B 3/02; E21B 19/16; E21B 33/06

See application file for complete search history.

(56) References Cited

U.S. PATENT DOCUMENTS

| | | | | |
|---|---|---|---|---|
| 2,083,204 | A * | 6/1937 | Schlesinger | H01J 29/46 313/481 |
| 4,979,842 | A * | 12/1990 | Miller | F16D 1/091 403/15 |
| 5,572,920 | A | 11/1996 | Kennedy et al. | |
| 6,231,262 | B1 * | 5/2001 | Whitney | F16D 1/0805 403/31 |
| 6,311,792 | B1 * | 11/2001 | Scott | E21B 19/10 166/379 |
| 6,929,287 | B2 | 8/2005 | Flindall | |
| 7,325,610 | B2 * | 2/2008 | Giroux | E21B 7/20 166/177.4 |
| 8,443,876 | B1 | 5/2013 | Keast | |
| 8,443,877 | B1 * | 5/2013 | Keast | E21B 21/106 166/332.3 |
| 2012/0125633 | A1 * | 5/2012 | Linde | E21B 33/085 166/381 |
| 2012/0192393 | A1 | 8/2012 | Sindelar | |
| 2013/0032360 | A1 * | 2/2013 | Stachowiak | E21B 33/06 166/379 |
| 2015/0376972 | A1 * | 12/2015 | Lock | |

* cited by examiner

*Primary Examiner* — David J Bagnell
*Assistant Examiner* — Yanick A Akaragwe
(74) *Attorney, Agent, or Firm* — Helene Raybaud

(57) ABSTRACT

A hydraulically deactivated clamp is provided. In one embodiment, an apparatus includes a movable clamping element disposed between two opposing rings. A shrink ring is clamped between the movable clamping element and one of the two opposing rings, and a fluid port enables hydraulic deactivation of the movable clamping element. Additional systems, devices, and methods are also disclosed.

16 Claims, 5 Drawing Sheets

HYDRAULICALLY DEACTIVATED CLAMP

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Whether onshore or offshore, a drilling rig can be provided to drill a well to access the desired resource. A drill string can be suspended from the drilling rig and rotated to drill the well. While the drill string can be suspended from a kelly and driven by a rotary table on the drill floor of the drilling rig, in some instances the drill string is instead suspended from and driven by a top drive of the drilling rig. Such a top drive generally includes a drive stem (also referred to as a main shaft or quill) that can be connected to the drill string. A motor in the top drive is connected to the drive stem to drive rotation of the drill string via the drive stem. Other components, such as inside blowout preventers, can be provided in line between the drive stem and the drill string. These other components rotate with the drive stem and the drill string, and tool joint safety clamps can be coupled to connections between the rotating components. The top drive can be raised and lowered via a hoisting system to raise and lower the drill string within the well.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

At least some embodiments of the present disclosure generally relate to clamps that can be hydraulically deactivated. In one embodiment, a clamp includes a spring-loaded clamping ring disposed in a housing. The springs bias the clamping ring to an activated position, in which the clamping ring is driven against a shrink ring to cause an inwardly directed force on the shrink ring. This inwardly directed force, in turn, causes the shrink ring to contract about shafts received within the clamp. In at least some instances, the clamp can be used to securely engage a rotary shouldered connection in a top drive system, such as between a drive stem and an internal blowout preventer. The clamp can be hydraulically deactivated by pumping fluid into the clamp to overcome the biasing force from the springs and allow relaxation of the shrink ring.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of the some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
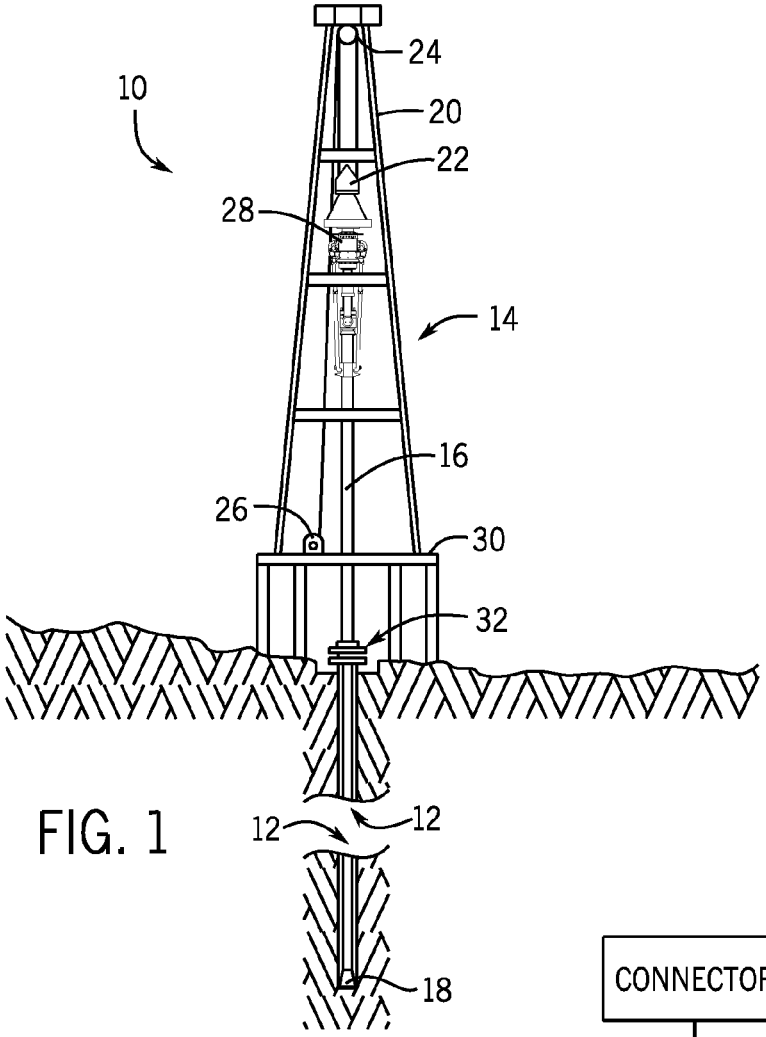
FIG. 1 generally depicts a drilling system having a top drive in accordance with an embodiment of the present disclosure.

Turning now to the present figures, a drilling system 10 is illustrated in FIG. 1 in accordance with one embodiment. Notably, the system 10 may be operated to drill a well 12 to access a subterranean resource, such as oil or natural gas. As depicted, the system 10 includes an onshore drilling rig 14, although the system 10 could instead be an offshore system in other embodiments. The drilling rig 14 uses a drill string 16 and a drill bit 18 to form the well 12. It will be appreciated that the drill string 16 can include various members, such as drill pipes, tool joints, drill collars, and a saver sub that prevents wear on a threaded connection of a rotating system (e.g., a top drive) that drives rotation of the drill string 16.

The drilling rig 14 also includes a mast 20 and a hoisting system (here generally shown as including a traveling block 22, a crown block 24, and drawworks 26) to enable a top drive 28 to be raised and lowered with respect to a drill floor 30. The drill string 16 is suspended from the top drive 28 through a hole in the drill floor 30 and through surface equipment (e.g., a blowout preventer 32 in the cellar). The drill string 16 can be rotated by the top drive 28 and can be raised and lowered with the top drive 28 (via the traveling block 22) to facilitate drilling operations.

Figure 2:
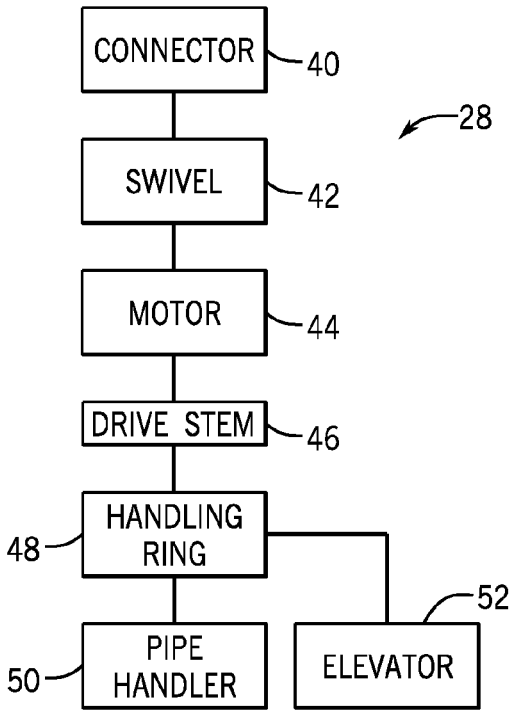
FIG. 2 is a block diagram of various components of a top drive in accordance with one embodiment.

One example of a top drive 28 is generally depicted in FIG. 2. In this embodiment, the top drive 28 includes a connector 40 for attaching the top drive 28 to the traveling block 22. A drive stem 46 is suspended from a swivel 42 through a motor 44, which drives rotation of the drive stem 46 within the top drive 28. The drive stem 46 (which is sometimes referred to as a main shaft or a quill) can be connected to a drill string 16 to cause the drill string 16 to rotate along with the drive stem 46. The top drive 28 of FIG. 2 also includes a handling ring 48 connected to a pipe handler 50 and to an elevator 52.

Figure 3:
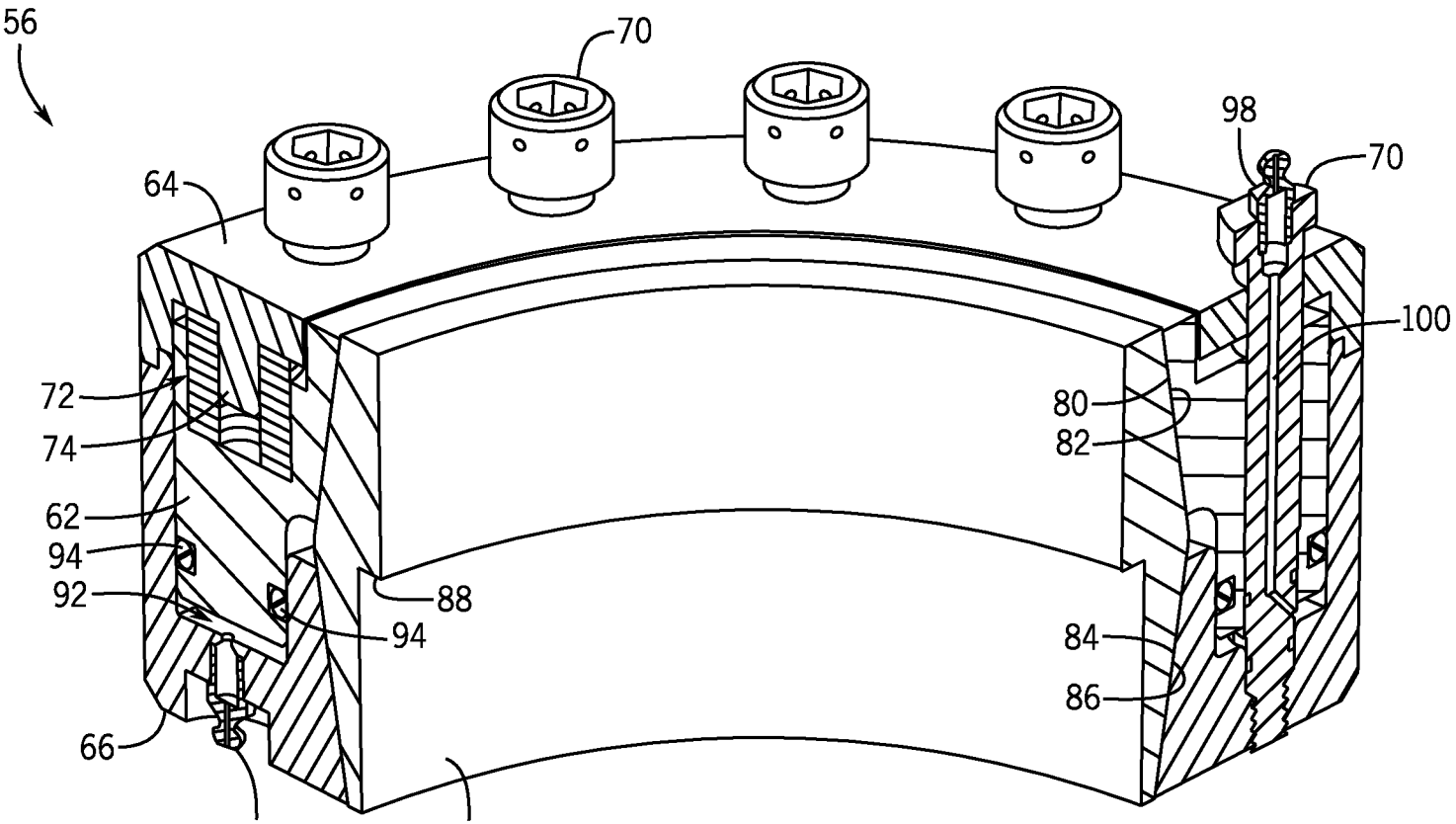
FIG. 3 is a sectioned view of a tool joint clamp that can be hydraulically deactivated in accordance with one embodiment.
Figure 4:
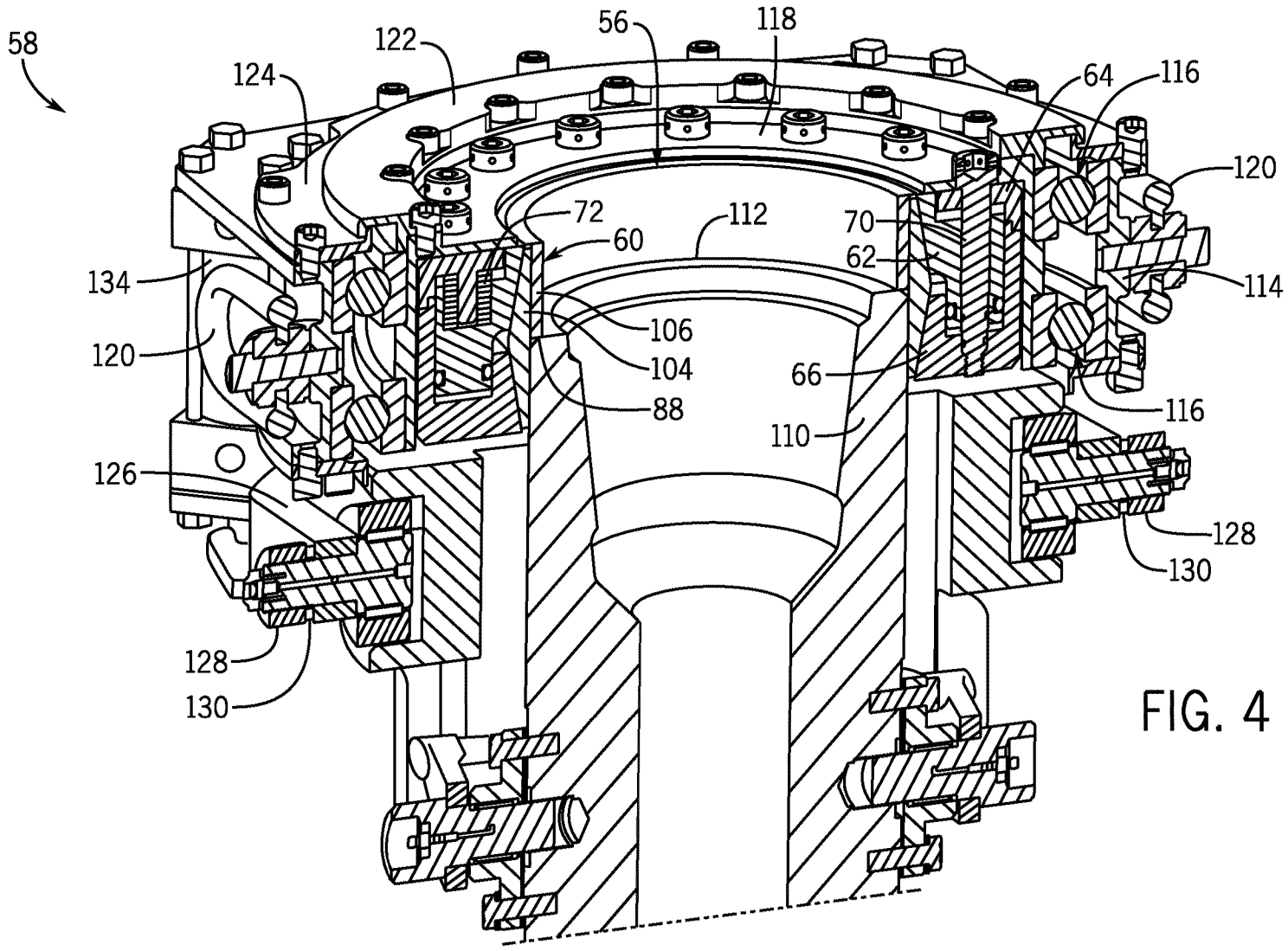
FIGS. 4 and 5 depict the tool joint clamp of FIG. 3 installed in a low-profile inside blowout preventer (IBOP) actuator system of a top drive in accordance with certain embodiments.
Figure 5:
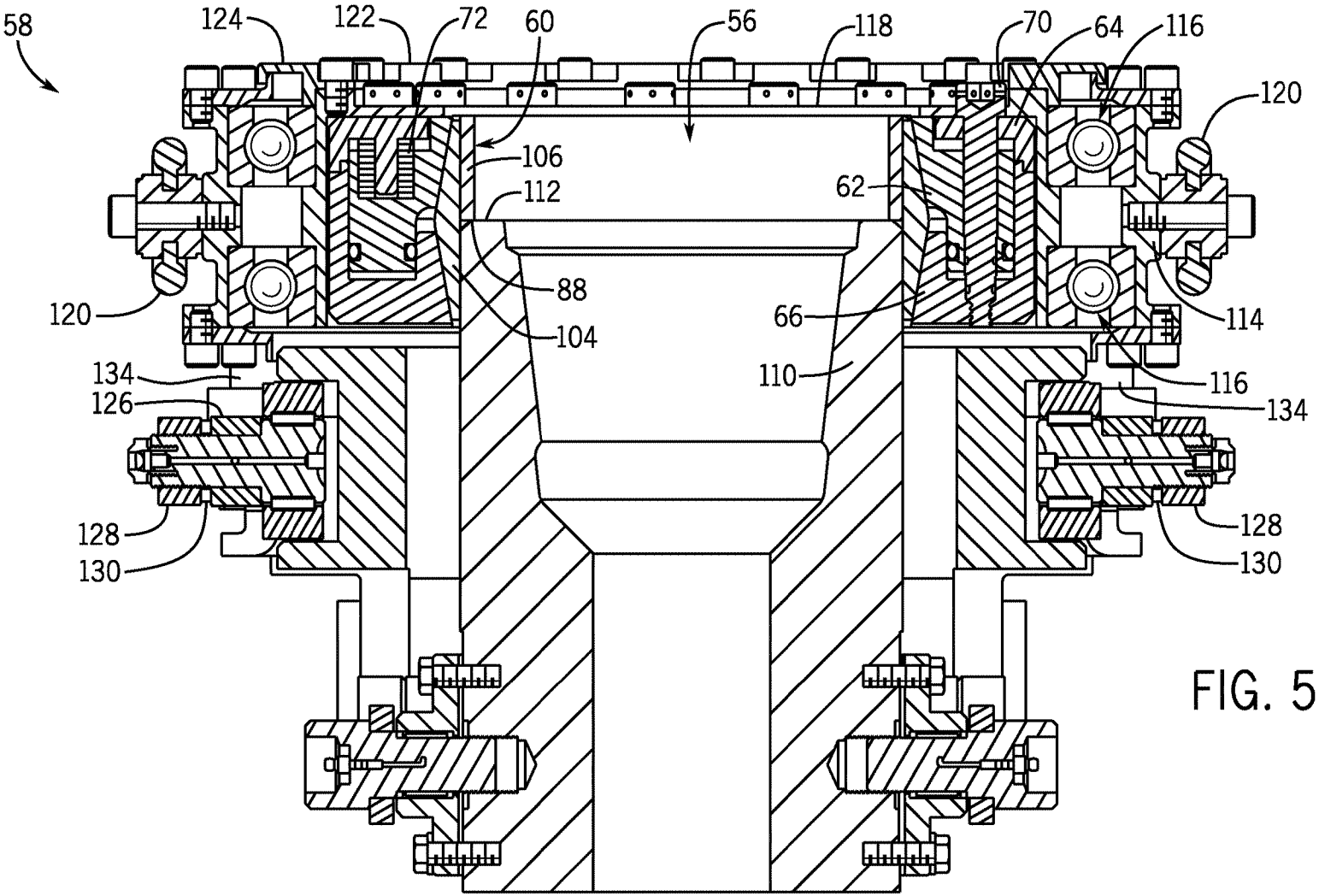
Figure 6:
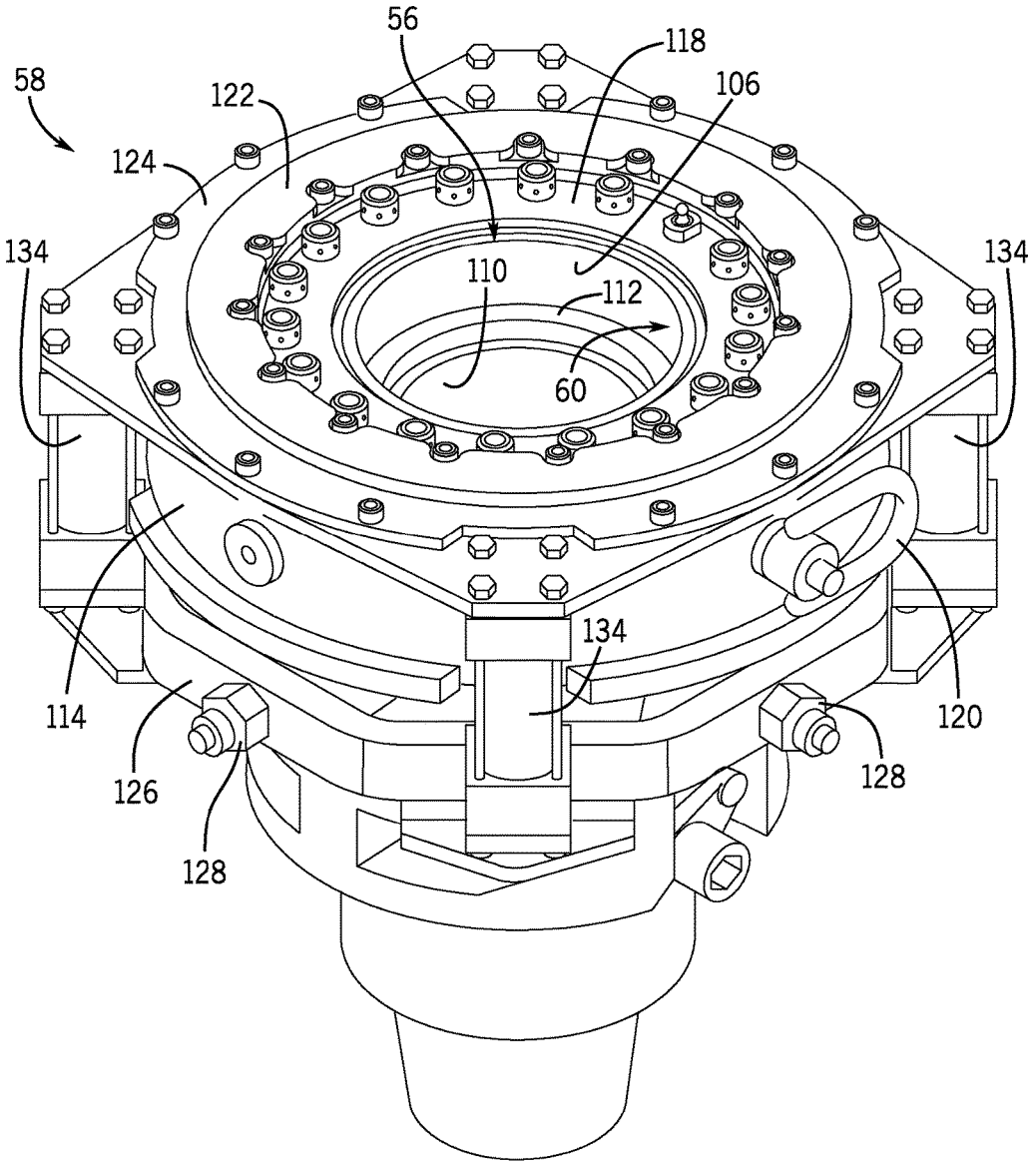
FIG. 6 is a perspective view of the low-profile inside blowout preventer (IBOP) actuator system of FIG. 4.

A hydraulically deactivated clamp 56 that can be used as a tool joint safety clamp is depicted in FIG. 3 in accordance with one embodiment. FIGS. 4-6 depict an inside blowout preventer (IBOP) system 58 having such a clamp 56 in accordance with certain embodiments. Shrink disc couplings have long been used for power transmission between two shafts. Top drives typically include shrink disc couplings utilized as "tool joint safety clamps," which act to maintain the make-up torque applied to rotary shouldered connections (RSCs) in line with the top drive main shaft. Often, top drives have three or more of such safety clamps. These clamps ensure that the level of make-up torque (MUT) applied stays constant (as increases and decreases in MUT can have negative effects), such that the axial load carrying and sealing capacity of the RSCs is not reduced.

A top drive can include an IBOP to inhibit uncontrolled flow up a drill string from a well. IBOP valves are routinely serviced (e.g., every few months), and the safety clamps are removed to enable such servicing. Removing a significant number of bolts (some past systems had 15 bolts or more) and torqueing them back when re-installing takes a long time in the field. The presently disclosed clamp, however, eliminates the need to remove the bolts and can be hydraulically energized for removal. In at least some instances, this new method reduces the downtime from several hours to several minutes, which may provide a substantial reduction in non-productive time related to IBOP valve replacement. Additionally, the clamp 56 of at least some embodiments does not have any user-serviceable parts and the components of clamp 56 can be assembled and pressure-tested at a factory or other facility before being deployed for field use. Such a clamp arrangement may also be helpful in the context of dropped object prevention, since it has no user-serviceable parts and does not require disassembly to remove or install (in contrast to previous shrink disc couplings with many bolts that need to be removed and installed in the field). The present technique is not limited to use on rotary shouldered connections as described above, as it can be used in any power transmission application where torque transmission is required between two axially co-located parallel shafts.

As depicted in FIG. 3, the clamp 56 includes a shrink ring 60 for securely engaging shafts, such as the main shaft 46 of the top drive 28 and the body of an internal blowout preventer 110 (FIG. 4) provided in line with the drill string 16. The clamp 56 (which is also referred to herein as a shrink ring coupling) includes a movable clamping element, shown here in the form of a retaining ring 62, positioned between two opposing rings in the form of upper housing 64 and lower housing 66. In the presently depicted embodiment, the upper and lower housings 64 and 66 are fastened together with bolts 70 that extend through the retaining ring 62.

One or more springs 72 (e.g., die disk springs provided about a pin 74 of the upper housing 64) apply a biasing force against the retaining ring 62. This causes the clamp 56 to be biased to its activated (or energized) position, in which the retaining ring 62 is pushed toward the lower housing 66 and against the shrink ring 60. As a result, the retaining ring 62 and the lower housing 66 push the shrink ring 60 inward (e.g., against shafts received within the shrink ring 60). More specifically, as shown in FIG. 3, the shrink ring 60 is clamped between the retaining ring 62 and the lower housing 66. As will be appreciated, the springs 72 can be preloaded via bolt torque (by tightening the bolts 70 to compress the springs 72). This spring preload force of the compressed springs 72 forces the retaining ring 62 and the lower housing 66 toward each other, and the engagement of tapered surfaces 80, 82, 84, and 86 creates hoop compressive stresses on the shrink ring 60 that result in contraction of the shrink ring 60 about the received shafts. In FIGS. 4-6, the bolts 70 are shown torqued with the heads of the bolts 70 abutting an intermediate component 118 (which is described below as a bearing carrier, but could take some other form). In FIG. 3, the component 118 has been omitted for clarity, resulting in small gaps visible between the top surface of the upper housing 64 and the bottom surfaces of the heads of the bolts 70. In practice, bolts 70 could be threaded down so that the heads tightly engage the component 118 (like in FIGS. 4-6) or some other intermediate component between the bolt heads and the top surface of the upper housing 64 to preload the springs 72. In other embodiments, bolts 70 could instead be threaded down so that the heads tightly engage the top surface of the upper housing itself to preload the springs 72.

In the presently depicted embodiment, the shrink ring 60 includes a shoulder 88 defined by different inner diameters of upper and lower portions of the shrink ring 60. These different inner diameters facilitate coupling of two shafts having different diameters (e.g., the drive stem 46 and an end of the internal blowout preventer 110) using the clamp 56. In other embodiments, the shoulder 88 is omitted and the shrink ring 60 has a single inner diameter.

Although the springs 72 bias the retaining ring 62 toward the lower housing 66 (and, more generally, bias the clamp 56 into an activated position with the shrink ring 60 closing against received shafts), the clamp 56 can be deactivated by pressurizing the interior of the clamp. As shown in FIG. 3, the clamp 56 includes an annular chamber 92 between the retaining ring 62 and the lower housing 66. Pressure-isolating annular seals 94 (e.g., o-rings) inhibit leakage of fluid from the chamber 92.

Fluid can be pumped into the chamber 92 to increase the pressure within the chamber. At sufficient pressure, force from the fluid in the chamber 92 would overcome the biasing force applied to the retaining ring 62 by the preloaded springs 72, pushing the retaining ring 62 away from the lower housing 66 and toward the upper housing 64 (further compressing the springs 72). This, in turn, reduces the inward forces on the shrink ring 60, which generally allows relaxation and radial expansion of the shrink ring 60. Consequently, disconnection of the clamp 56 from received shafts can include pressurizing the chamber 92 to cause the shrink ring 60 to release the shafts. Similarly, to facilitate connection of the clamp 56, the chamber 92 can be pressurized to allow the shafts to be received within the relaxed shrink ring 60. The pressure can then be reduced to cause the retaining ring 62 and the lower housing 66 to tighten the shrink ring 60 against the shafts.

Pressurized fluid can be routed into the chamber 92 in any suitable manner, such as through a disconnect pressure port of the upper housing 64 or the lower housing 66. By way of example, a pump or some other fluid source could be connected to a fitting 96 or a fitting 98 having the disconnect pressure port to route fluid into the chamber 92. As shown in FIG. 3, the fitting 96 is coupled to the lower housing 66 to allow fluid (e.g., hydraulic or pneumatic fluid) to be pumped through a conduit into the chamber 92. The fitting 98 is coupled to a bolt 70 at the upper housing 64, and this bolt 70 includes a conduit 100 in fluid communication with the chamber 92 to allow fluid to be pumped into the chamber through the fitting 98 and the bolt 70. Although the clamp 56 is shown here as including both fittings 96 and 98 for purposes of explanation, in some other embodiments either or both of these fittings could be omitted from the clamp 56. As depicted in FIG. 3, seals (e.g., o-rings) are provided about the bolt 70 having the conduit 100 to inhibit leakage from the chamber 92 along the bolt 70. Hydraulic (or pneumatic) pressure to the chamber 92 can be supplied by a hand pump or some other suitable source.

An example of a clamp 56 that can be hydraulically deactivated is shown incorporated into an IBOP system 58 in FIGS. 4-6. In these figures, the shrink ring 60 is depicted as having a tapered outer body 104 (with tapered surfaces 82 and 86 described above) coupled to an inner ring 106 that provides the shoulder 88. The inner ring 106 accommodates coupling of the clamp 56 to a narrower shaft in the upper end of the shrink ring 60 (e.g., the drive stem 46), compared to a wider shaft in the lower end of the shrink ring 60 (e.g., the upper end of the IBOP 110). As depicted, the shoulder 88 of the shrink ring 60 abuts an upper surface or shoulder 112 of the IBOP 110.

The clamp 56 is provided within a housing 114 of the system 58. Bearings 116 between the clamp 56 and the housing 114 enable rotation of the clamp 56 with respect to the housing. The inner races of the bearings 116 are installed on a bearing carrier 118 coupled to the clamp 56 and the outer races are installed against interior walls of the housing 114. Anti-rotation shackles 120 are coupled to the housing 114 and can be engaged to hold the housing 114 stationary while the clamp 56 rotates with the IBOP 110 during operation of the top drive 28. Annular plates 122 and 124 retain the bearing races within the housing 114.

The system 58 also includes a roller cradle 126. The cradle 126 includes four rollers with stems extending outwardly through apertures in a frame. Nuts 128 and washers 130 are provided on the ends of the stems to secure the rollers to the frame. To disassemble the system 58, the nuts 128 and washers 130 can be removed and the rollers can be moved to maintenance pockets on the housing. The clamp 56 can then be disconnected (by sufficiently pressurizing the chamber 92, as described above) and the upper part of the actuator system can be raised. It will be appreciated that installation can be performed in the reverse order, including the clamp 56 receiving ends of two components (e.g., the drive stem 46 and the IBOP 110) within the shrink ring 60 and then venting pressure from the chamber 92 so that the springs 72 drive the retaining ring 62 against the shrink ring 60 and cause the shrink ring 60 to securely engage the received ends of the two components. The system 58 also includes hydraulic cylinders 134 for moving an actuator, which can be used during operation of the top drive to engage crank arms on opposite sides of the IBOP 110 to open and close the valve.

In at least some instances, existing top drive systems can be retrofitted with the clamp 56 described above. For example, the clamp 56 can be sized to have the same foot print as previous tool joint safety clamps (e.g., the traditional bolt-based shrink disc coupling). This allows removal of the previous safety clamps of a top drive and replacement with the clamps 56.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus including:

an inside blowout preventer;

a movable clamping element disposed axially between two opposing rings;

a shrink ring coupled to the inside blowout preventer and clamped between the movable clamping element and a first of the two opposing rings;

a spring-loaded element applying a biasing force against the movable clamping element to push the movable clamping element towards the first of the two opposing rings and toward engagement with the shrink ring;

an annular chamber between the first of the two opposing rings and the movable clamping element; and a first fluid port coupled to the first of the two opposing rings to enable fluid to enter the annular chamber and push the movable clamping element away from the first of the two opposing rings towards the second of the two opposing rings, overcoming the biasing force and unclamping the shrink ring.

2. The apparatus of claim 1, wherein the fluid port is provided in one of the two opposing rings.

3. The apparatus of claim 1, wherein the two opposing rings are fastened to one another with bolts extending through the movable clamping element.

4. The apparatus of claim 3, wherein the fluid port is provided in one of the bolts.

5. The apparatus of claim 1, comprising a top drive wherein a main shaft of the top drive and a body of the inside blowout preventer are engaged by the shrink ring.

6. The apparatus of claim 1, comprising:

a second fluid port coupled to the second of the two opposing rings to enable the fluid to enter the annular chamber and push the movable clamping element away from the first of the two opposing rings towards the second of the two opposing rings.

7. The apparatus of claim 1, wherein the shrink ring clamped between the movable clamping element and one of the two opposing rings includes a first outer tapered surface in mating engagement with a tapered surface of the movable clamping element and a second outer tapered surface in mating engagement with a tapered surface of the first of the two opposing rings.

8. An apparatus comprising:

an inside blowout preventer;

a housing;

a clamp disposed within the housing; and a bearing positioned between the clamp and the housing to permit rotation of the clamp with respect to the housing;

wherein the clamp includes a shrink ring coupled to the inside blowout preventer and engaged by opposing clamping elements, the clamp is biased by a spring-loaded element applying a biasing force against a movable clamping element to push the movable clamping element towards a first of the opposing clamping element and toward engagement with the shrink ring to an activated position, and the clamp includes a disconnect pressure port coupled to the first of the opposing clamping elements and in fluid communication with a chamber between the first of the opposing clamping elements and the movable clamping element such that the clamp can be deactivated by pumping fluid into the chamber through the disconnect pressure port.

9. The apparatus of claim 8, wherein the clamp is a tool joint safety clamp of a top drive.

10. The apparatus of claim 9, wherein the clamp is biased to an activated position by a spring that applies a biasing force to the first of the opposing clamping elements.

11. A method comprising:

providing an apparatus comprising:

an inside blowout preventers;

a movable clamping element disposed axially between two opposing rings;

a shrink ring coupled to the inside blowout preventer and clamped between the movable clamping element and a first of the two opposing rings;

a spring-loaded element applying a biasing force against the movable clamping element to push the movable clamping element towards the first of the two opposing rings and toward engagement with the shrink ring;

an annular chamber between the first of the two opposing rings and the movable clamping element; and a first fluid port coupled to the first of the two opposing rings to enable fluid to enter the annular chamber and push the movable clamping element away from the first of the two opposing rings towards the second of the two opposing rings, overcoming the biasing force and unclamping the shrink ring applying hydraulic pressure to the shrink ring to deactivate the shrink ring; and disassembling the movable clamping element and the first of the two opposing rings that were connected together by the shrink ring coupling.

12. The method of claim 11, wherein applying hydraulic pressure to the shrink ring coupling to deactivate the shrink ring coupling includes pumping fluid into the fluid port of the shrink ring coupling to compress a spring and reduce inward force on the shrink ring of the shrink ring coupling.

13. The method of claim 12, wherein pumping fluid into the shrink ring coupling includes using a hand pump to pump the fluid into the shrink ring coupling.

14. The method of claim 11, wherein disassembling two components that were connected together by the shrink ring coupling includes separating a drive stem of a top drive from an internal blowout preventer.

15. The method of claim 11, wherein applying hydraulic pressure to the shrink ring coupling includes pumping fluid into the shrink ring coupling through a bolt that includes the fluid port and connects the two opposing rings of the shrink ring coupling.

16. The method of claim 11, comprising installing the shrink ring coupling by receiving the two components within the shrink ring of the shrink ring coupling and releasing pressure from within the shrink ring coupling to cause the shrink ring to securely engage the two components received within the shrink ring.

* * * * *